US005324175A

United States Patent [19]

Sorensen et al.

[11] Patent Number: 5,324,175

[45] Date of Patent: Jun. 28, 1994

[54] PNEUMATICALLY OPERATED RECIPROCATING PISTON COMPRESSOR

[75] Inventors: Harold P. Sorensen, Marblehead, Mass.; Ward H. Robinson, Newton, N.H.

[73] Assignee: Northern Research & Engineering Corporation, Woburn, Mass.

[21] Appl. No.: 56,272

[22] Filed: May 3, 1993

[51] Int. Cl.[5] ..... F04B 3/00

[52] U.S. Cl. ..... 417/254; 417/397

[58] Field of Search ..... 417/254, 264, 267, 268, 417/397; 91/341 R

[56] References Cited

U.S. PATENT DOCUMENTS 3,249,289 5/1966 Maglott .
4,102,609 7/1978 Wood ..... 417/399
4,104,008 8/1978 Hoffmann et al. ..... 417/397
4,382,750 5/1983 Robertson et al. ..... 417/397
4,653,986 3/1987 Ashton ..... 417/397
4,684,332 8/1987 Hartley et al. ..... 417/397

*Primary Examiner*—Richard A. Bertsch
*Assistant Examiner*—Alfred Basichas
*Attorney, Agent, or Firm*—Michael H. Minns

[57] ABSTRACT

A two stage free piston pneumatically operated air compressor having an integral and coaxial power piston, first stage piston and second stage piston. The discharge of the compressor first stage is the inlet for the compressor second stage. A piston-type throttling valve is used to control the speed of the reciprocating piston. The piston-type throttling valve is responsive to the pressure drop across a fixed orifice.

18 Claims, 2 Drawing Sheets

PNEUMATICALLY OPERATED RECIPROCATING PISTON COMPRESSOR

BACKGROUND OF THE INVENTION

This invention relates generally to reciprocating piston compressors and more particularly to pneumatically operated reciprocating piston compressors, also known as "free piston" compressors.

Typically pneumatic free piston compressors compress air to a few hundred psia. Prior art pneumatic free piston compressors are usually not capable of producing high pressure compressed air, such as 1000 psia.

The foregoing illustrates limitations known to exist in present pneumatically operated reciprocating piston compressors. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a pneumatically operated compressor comprising: a first stage compression chamber and a second stage compression chamber, each compression chamber having an inlet and a discharge; a reciprocating piston assembly having a pneumatically actuated piston, a first stage compression piston and a second stage compression piston; and a control means for controlling the application of a source of compressed gas to the pneumatically actuated piston; the discharge of the first stage compression chamber being in fluid communication with the inlet of the second stage compression chamber.

The foregoing and other aspects will become apparent from the following detailed description of the invention when considered in conjunction with the accompanying drawing figures.

BRIEF DESCRIPTION OF THE DRAWING FIGURES

FIG. 1 is a schematic diagram of fuel manifold purging mechanism incorporating a pneumatically operated compressor of the present invention; and FIG. 2 is cross-sectional side view of the pneumatically operated compressor shown in FIG. 1.

DETAILED DESCRIPTION

Figure 2:
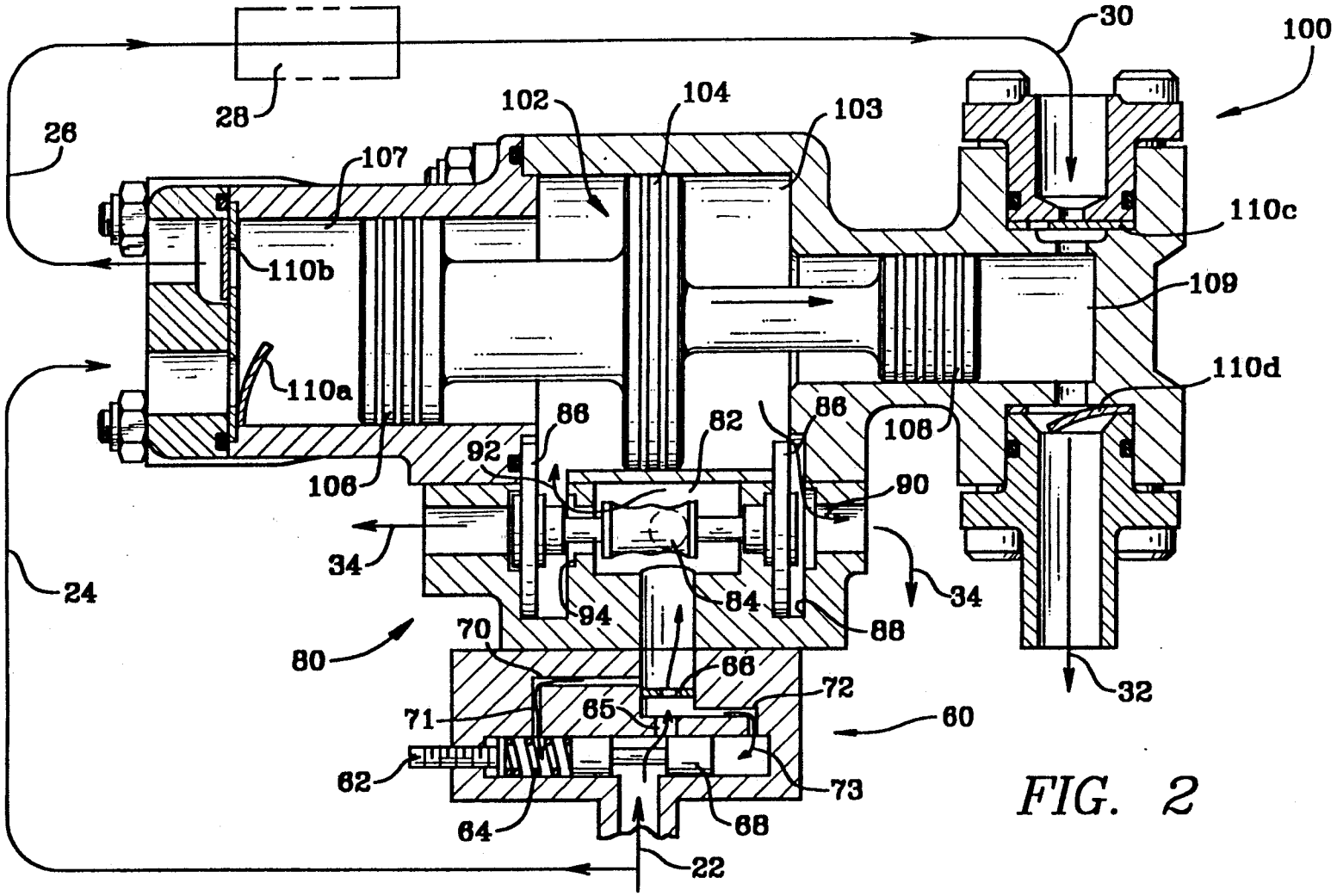

FIG. 2 shows a two stage pneumatically actuated air compressor. One intended use for this air compressor is to provide compressed air for expelling residual fuel from the fuel manifold and nozzles in turbine engines during shutdown of the turbine engine. This use of the two stage free piston air compressor requires no energy source other than the excess compressor discharge air from the turbine engine.

Turbine engines are shut down by closing the valve in the discharge line of the fuel control, which cuts off the flow of fuel to the engine. However, the fuel nozzles in the burners and the fuel manifold leading to the nozzles are left full of fuel. Heat transmitted to the fuel nozzles and fuel manifold by radiation, conduction, and convection heats this fuel. If the temperature of the fuel reaches or exceeds the level at which decomposition occurs, the products of decomposition will precipitate out of the fuel and may block or alter the spray of one or more nozzles or may restrict the flow through the fuel manifold. The hot spots thus produced may cause rapid deterioration of the burner and of the turbine nozzle. This will result in a reduction in the useful output of the engine and in an increase in fuel consumption. From an operational point of view, the machine will have to be removed from service before its scheduled time.

The fuel purging mechanism consists of an air-powered compressor 10, a storage reservoir 36 and ancillary components to raise and store enough air at a pressure high enough to be able, on demand, to blow all of the residual fuel from the fuel manifold 46 and nozzles of a gas turbine engine 1 during shut down. The system contains heat exchangers 12, 28 to protect the components from excessive temperature and to reduce to a practical minimum the amount of work that the air powered compressor 10 must do, a filter 18 to protect the system from unacceptable debris, and valves 14, 38, switches 16, 42, and regulators 44 to operate the system and to release the air to the fuel manifold 46 in response to a signal from the operator.

Figure 1:
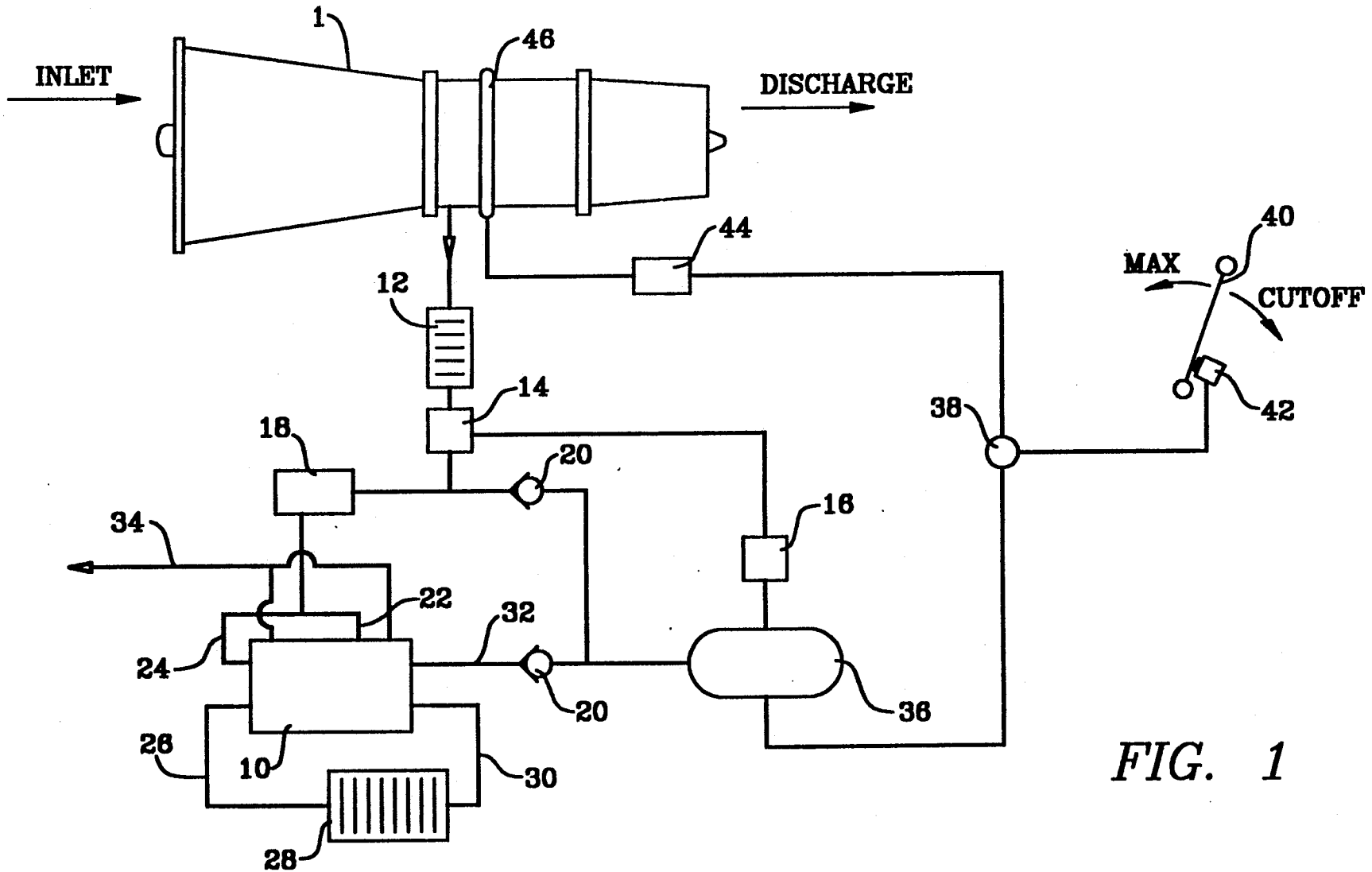

The schematic diagram, FIG. 1, shows the turbine engine 1, the fuel manifold 46, the nozzle purge system, and the power lever or throttle 40 by which the operator starts the turbine engine 1, controls its speed, shuts it down, and actuates the fuel purge system.

To minimize the amount of work that the pneumatically actuated air compressor 10 for the purge system must do, the source air for the purge system is the highest pressure air that is available, the discharge from the last stage of the turbine engine's 1 compressor. Typically, the last stage compressor discharge pressure is 205 psia at 686° F. Because the compressor 10 is air powered and uses the input air as its energy source, using the highest pressure air that is available minimizes the size and weight of the compressor.

The discharge air from the turbine engine's 1 compressor is passed through a heat exchanger 12 to reduce its temperature to an acceptable level. The air then passes through a control valve 14 which is controlled by pressure in the air reservoir 36. A pressure switch 16 is used to sense the pressure in the reservoir 36. This control valve 14 is normally open and closes when the desired pressure is reached in the reservoir 36. After passing through control valve 14, the air branches into two paths, one to a check valve 20 and the other through a filter 18 to the air compressor 10. The air path through the check valve 20 serves to charge the reservoir 36 to the discharge pressure of the turbine engine's 1 compressor without any action by the air compressor 10. The filter 18 in the other branch serves to remove any contaminant particles from the air going to the air compressor 10.

The air going to the air compressor 10 is further divided into two paths, one to be compressed 24, and the other to do the work of compressing 22. The compressing air 22, after performing its function, is exhausted to the atmosphere 34. The compressed air 24, after being compressed by the first stage of the air compressor 10, passes through a heat exchanger 28 before it enters the second stage of the air compressor 10. The inlet 24 of the first stage of the air compressor 10 has a pressure of 185 psia and a temperature of 400° F. The inlet 30 of the second stage has a pressure of 440 psia and a temperature of 400° F. From the second stage of the air compressor 10, the compressed air passes through a pressure actuated check valve 20 into the reservoir 36. The discharge 32 of the second stage is at a pressure of 1068 psia and a temperature of 643° F. When the required pressure is reached in the reservoir 36, the pressure sensing switch 16 is actuated, which closes the control valve 14 in the inlet to the air compressor 10. This action cuts off air supply to the fuel purge system. To keep the reservoir 36 as small as is practical, the storage pressure is set higher than is desired in the fuel manifold 46. Therefore, a pressure regulator 44 is used in the line between the reservoir 36 and the fuel manifold 46. When the operator moves the power lever 40 to the cutoff position, the fuel flow to the fuel manifold 46 is shut off and an actuating smith 42 will be operated. This switch 42 activates the fuel manifold purging system by opening actuating valve 38. This opens the line from the reservoir 36 to the regulator valve 44 and the stored air will flow from the reservoir 36 through the regulator valve 44 into the fuel manifold 46 and will blow any fuel that remains in the fuel manifold 46 out through the fuel nozzles and into the turbine engine 1, where it will be vaporized and exhausted by the airflow through the turbine engine 1 as it coasts to a stop.

The air compressor 10 is unique to the fuel manifold purge system and is shown with a speed regulator 60, a piston controller 80 and a two stage free piston compressor 100 in FIG. 2. The air compressor 10 is a coaxial, two stage pump with the power section position between and on the same axis with the pump pistons 106, 108.

The speed regulator 60, which controls the output flow of the air compressor by controlling the speed at which the piston assembly 102 strokes, is in the inlet line 22 to the compressor 10. The speed regulator 60 uses a piston-type throttling regulator valve 68 that is designed to hold a fixed pressure across a flow orifice 66 with a fixed area by controlling the flow through the flow orifice 66. This is accomplished by having the pressure downstream 71 of the orifice 66 ported through an internal passageway 70 to one end of piston valve 68. A biasing means 64, preferably a spring also operates against the downstream end of the piston valve 68. An adjusting screw 62 is provided to adjust the spring force against the downstream end of the piston valve 68. Pressure upstream 73 of the flow orifice 66 is ported through passageway 72 to the end of the piston valve 68 opposite the spring end of the piston valve 68. Thus, if the flow through the flow orifice 66 is too high, the increased pressure drop across the flow orifice 66 will be felt on the piston valve 68 as a decrease in the downstream pressure 71 on the spring end of the piston valve 68 relative to the upstream pressure 73 on the opposite end of the piston valve 68, therefore causing the piston valve 68 to move in the direction of the spring 64. This will cause the piston valve 68 to partially cover an inlet passageway 65 to reduce the flow of air to the piston controller 80 and the compressor section 100.

Conversely, if the flow through the flow orifice 66 is too low, the decreased pressure drop across the flow orifice 66 will be felt on the piston valve 68 as a increase in the downstream pressure 71 on the spring end of the piston valve 68 relative to the upstream pressure 73 on the opposite end of the piston valve 68, therefore causing the piston to move away from the spring 64. This will cause the piston valve 68 to partially open the inlet passageway 65 to increase the flow air to the piston controller 80 and the compressor section 100.

From the speed regulator 60, the airflow to the compressor or power section 100 of the air compressor 10 goes through a piston controller 80 which ports high pressure air or atmospheric exhaust to one side or the other of the power piston 104, thus alternately driving the power piston 104 to one end or the other of its travel.

The compressor section 100 of the air compressor 10 is primarily comprised of a piston assembly 102, a power piston chamber 103, a first stage compression chamber 107 and a second stage compression chamber 109. The piston assembly 102 is comprised of a power piston 104, a first stage piston 106 and a second stage piston 108. The three pistons 104, 106, 108 are integral with one another and coaxial. The power piston 104 diameter is larger than the first stage piston 106 diameter. The first stage piston 106 diameter is larger than the second stage piston 108 diameter. (FIG. 2 shows the piston assembly 102 moving to the right, as shown by the directional arrow.)

When the power piston 104 strokes, the first and second stage pistons 106, 108 stroke also. When the piston assembly 102 moves to the right, air will be drawn in through low pressure intake reed valve **110*a* and into the low-pressure, or first stage compression chamber 107. High pressure air is expelled from the high-pressure or second stage compression chamber 109 through high pressure discharge reed valve 110*d* into the reservoir 36. When the piston assembly moves to the left, intermediate pressure air is forced out of the first stage compression chamber 107 through low-pressure discharge reed valve 110*b*. The intermediate pressure air passes through heat exchanger, or intercooler 28 prior to entering the second stage compression chamber 109 through high-pressure intake reed valve 110*c*. Piston controller 80 controls the admission of supply air to and exhaust from power piston chamber 103**.

The piston controller 80 primarily consists of a pilot or shuttle valve 82. As shown in FIG. 2 with the piston assembly 102 traveling from left to right, drive air 92 is being admitted to the left side of the power piston chamber 103 and exhaust air 90 is being exhausted from the right side of the power piston chamber 103. Each end of the pilot valve 82 has a drive flow valve 86 thereon which projects into the power piston chamber 103. As the power piston 104 reaches an end of a stroke, a face of the power piston 104 contacts a projecting drive flow valve 86 and moves the pilot valve 82 in the direction to port flow to the opposite end of the power piston chamber 103. When the pilot valve 82 moves to the opposite position, one drive flow valve 86 closes against the exhaust air seat 88 and moves off the drive air seat 94. This closes the exhaust air path and opens the drive air path for one side of the power piston chamber 103. The other drive flow valve 86 closes against the drive air seat 94 and moves off the exhaust air seat 88. This opens the exhaust air path and closes the drive air path for the other side of the power piston chamber 103.

The center portion of the pilot valve 82 contains detents 84 with corresponding detent followers in the housing of the piston controller 80. Thus, as soon as the pilot valve 82 has been started in motion by the power piston 104 striking one of the projecting drive flow valves 86, the force created by the detent followers in the detents 84 will move the pilot valve 82 rapidly to the opposite extreme of its travel. The action of the pilot valve 82 will cause the power piston 104 to stroke alternately in one direction and the other. The air discharged from the power piston chamber 103 through the pilot valve 82 will be expelled to the atmosphere.

Having described the invention, what is claimed is:

1. A pneumatically operated compressor comprising:

a source of compressed gas;

a first stage compression chamber;

a second stage compression chamber;

each compression chamber having an inlet and a discharge;

the source of compressed gas being supplied to the inlet of the first stage compression chamber;

a reciprocating piston assembly having a pneumatically actuated piston, a first stage compression piston and a second stage compression piston; and a control means for controlling the application of the source of compressed gas to the pneumatically actuated piston;

the discharge of the first stage compression chamber being in fluid communication with the inlet of the second stage compression chamber.

2. The pneumatically operated compressor according to claim 1, further comprising:

a speed regulating means for regulating the speed of the reciprocating piston assembly.

3. The pneumatically operated compressor according to claim 2 wherein the speed regulating means comprises a piston-type throttling valve responsive to variations in pressure and a flow orifice, the piston-type throttling valve moving in response to variations in pressure drop across the flow orifice to throttle flow to the flow orifice thereby maintaining a pre-determined pressure drop across the flow orifice.

4. The pneumatically operated compressor according to claim 2 wherein the speed regulating means comprises a piston-type throttling valve having a first end and a second end, a flow orifice, a biasing means operating against the first end of the piston-type throttling valve and an adjustment means, pressure downstream of the flow orifice being ported to the first end of the piston-type throttling valve, pressure upstream of the flow orifice being ported to the second end of the piston-type throttling valve, the piston-type throttling valve moving in response to variations in the pressure drop across the flow orifice to throttle flow to the flow orifice thereby maintaining a pre-determined pressure drop across the flow orifice, the adjustment means adjusting the biasing means, thereby adjusting the predetermined pressure drop across the flow orifice.

5. The pneumatically operated compressor according to claim 1 wherein the pneumatically actuated piston is located between the first stage compression piston and the second stage compression piston.

6. The pneumatically operated compressor according to claim 1 wherein the pneumatically actuated piston, the first stage compression piston and the second stage compression piston are coaxial.

7. The pneumatically operated compressor according to claim 1, further comprising:

a heat exchanger for cooling the discharge of the first stage compression chamber.

8. The pneumatically operated compressor according to claim 1 further comprising:

a power piston chamber, the pneumatically actuated piston being located within the power piston chamber and dividing the power piston chamber into a first sub-chamber and a second subchamber;

the control means comprising a pilot valve being moveable between a first position and a second position, the pilot valve in the first position admitting compressed gas to the first subchamber and exhausting gas from the second sub-chamber, the pilot valve in the second position admitting compressed gas to the second sub-chamber and exhausting gas from the first sub-chamber; and a reversing means for moving the pilot valve from one position to the other position.

9. The pneumatically operated compressor according to claim 8 wherein the reversing means comprises two projections on the pilot valve, the pneumatically actuated piston alternately impacting one of the projections and the other of the projections, thereby causing the pilot valve to move from one position to the other position.

10. The pneumatically operated compressor according to claim 9, further comprising:

a detent on the pilot valve and a detent follower in engagement with the detent, the detent and detent follower producing a force to move the pilot valve rapidly to the opposite position after the pneumatically actuated piston impacts a pilot valve projection.

11. A pneumatically operated compressor, the compressor having a first stage compression chamber and a second stage compression chamber, each compression chamber having an inlet and a discharge; the compressor comprising:

a reciprocating piston assembly having a pneumatically actuated piston, a first stage compression piston and a second stage compression piston, the diameter of the first stage compression piston being larger than the diameter of the second stage compression;

a power piston chamber, the pneumatically actuated piston being located within the power piston chamber and dividing the power piston chamber into a first sub-chamber and a second sub-chamber; and a control means for controlling the application of a source of compressed gas to the pneumatically actuated piston, the control means comprising a pilot valve having a pair of spaced apart sealing surfaces and two sets of inlet and exhaust seats, the pilot valve being movable from a first position admitting compressed gas to the first sub-chamber and exhausting gas from the second sub-chamber, to a second position admitting compressed gas to the second sub-chamber and exhausting gas from the first sub-chamber, each pilot valve sealing surface alternately sealing against an inlet seat and an exhaust seat, each pilot valve sealing surface projecting into the power piston chamber, the pneumatically actuated piston alternately impacting one of the pilot valve projecting sealing surfaces and the other of the pilot valve projecting sealing surfaces, thereby causing the pilot valve to move from one position to the other position.

12. The pneumatically operated compressor according to claim 11 wherein the discharge of the first stage compression chamber is in fluid communication with the inlet of the second stage compression chamber.

13. The pneumatically operated compressor according to claim 12, further comprising:

a heat exchanger for cooling the discharge of the first stage compression chamber.

14. The pneumatically operated compressor according to claim 11 wherein the pneumatically actuated piston, the first stage piston and the second stage piston are coaxial.

15. The pneumatically operated compressor according to claim 11, further comprising:

a speed regulating means for regulating the speed of the reciprocating piston assembly.

16. A reciprocating piston compressor comprising:

a first stage compression chamber;

a second stage compression chamber;

a power piston chamber;

each compression chamber having an inlet and a discharge;

a compression means for compressing a fluid, the compression means comprising a power piston, a first stage piston and a second stage piston, the power piston, the first stage piston and the second stage piston being coaxial and integral with one another;

a control means for controlling the application of a source of compressed gas to the power piston; and a speed regulating means for regulating the speed of the reciprocating piston, the speed regulating means comprising a piston-type throttling valve having a first end and a second end, a flow orifice, a biasing means operating against the first end of the piston-type throttling valve and an adjustment means, pressure downstream of the flow orifice being ported to the first end of the piston-type throttling valve, pressure upstream of the flow orifice being ported to the second end of the piston-type throttling valve, the piston-type throttling valve moving in response to variations in the pressure drop across the flow orifice to throttle flow to the flow orifice thereby maintaining a pre-determined pressure drop across the flow orifice, the adjustment means adjusting the biasing means, thereby adjusting the pre-determined pressure drop across the flow orifice.

17. The reciprocating piston compressor according to claim 16 wherein the discharge of the first stage compression chamber is in fluid communication with the inlet of the second stage compression chamber.

18. The reciprocating piston compressor according to claim 16 wherein the diameter of the power piston is larger than the diameter of the first stage piston and the diameter of the first stage piston is larger than the diameter of the second stage piston.

* * * * *